US008771441B2

(12) United States Patent
Bes et al.

(10) Patent No.: US 8,771,441 B2
(45) Date of Patent: Jul. 8, 2014

(54) HIGH FRACTURE TOUGHNESS ALUMINUM-COPPER-LITHIUM SHEET OR LIGHT-GAUGE PLATES SUITABLE FOR FUSELAGE PANELS

(76) Inventors: Bernard Bes, Seyssins (FR); Herve Ribes, Clermont Ferrand (FR); Christophe Sigli, Grenoble (FR); Timothy Warner, Voreppe (FR)

( * ) Notice: Subject to any disclaimer, the term of this patent is extended or adjusted under 35 U.S.C. 154(b) by 1142 days.

(21) Appl. No.: 11/612,131

(22) Filed: Dec. 18, 2006

(65) Prior Publication Data

US 2007/0181229 A1 Aug. 9, 2007

Related U.S. Application Data

(60) Provisional application No. 60/762,864, filed on Jan. 30, 2006.

(30) Foreign Application Priority Data

Dec. 20, 2005 (FR) ..... 05 12931
Dec. 14, 2006 (WO) ..... PCT/FR06/02733

(51) Int. Cl.

| | |
|---|---|
| ***C22F 1/04*** | (2006.01) |
| ***C22C 21/00*** | (2006.01) |
| ***C22C 21/12*** | (2006.01) |
| ***C22C 21/06*** | (2006.01) |
| ***C22C 21/16*** | (2006.01) |
| ***C22C 21/04*** | (2006.01) |
| ***C22C 21/14*** | (2006.01) |

(52) U.S. Cl.

USPC ..... 148/552; 148/549; 148/415; 148/416; 148/417; 420/528; 420/529; 420/533; 420/534; 420/535; 420/536; 420/537; 420/538; 420/539

(58) Field of Classification Search

None

See application file for complete search history.

(56) References Cited

U.S. PATENT DOCUMENTS

| | | | |
|---|---|---|---|
| 4,961,792 A | 10/1990 | Rioja et al. | |
| 5,032,359 A | 7/1991 | Pickens et al. | |
| 5,066,342 A | 11/1991 | Rioja et al. | |
| 5,234,662 A | 8/1993 | Balmuth et al. | |

FOREIGN PATENT DOCUMENTS

| | | | | |
|---|---|---|---|---|
| WO | WO 02/063059 | * | 8/2002 | ..... C22F 1/057 |
| WO | WO2004106570 | | 9/2004 | |

OTHER PUBLICATIONS

Elliott et al, Optimal Design of Fuselage Structures, 342 Int'l Council of the Aeronautical Sciences 1-8 (2002).*

ASM-Specialty Handbook. (1994). pp. 121-142.

Proceedings of the Sixth International Aluminum-Lithium Conference. Garmisch-Partenkirchen. (1991). pp. 187-201.

Starke, E.A. & Lin, F.S. (1982). The Influence of Grain Structure on the Ductility of the Al-Cu-Li-Mn-Cd Alloy 2020. Metallurgical Transactions, 13A, pp. 2259-2269.

* cited by examiner

*Primary Examiner* — Yoshitoshi Takeuchi

(74) *Attorney, Agent, or Firm* — Miles and Stockbridge

(57) ABSTRACT

An aluminum alloy comprising 2.1 to 2.8 wt. % Cu, 1.1 to 1.7 wt. % Li, 0.1 to 0.8 wt. % Ag, 0.2 to 0.6 wt. % Mg, 0.2 to 0.6 wt. % Mn, a content of Fe and Si less or equal to 0.1 wt. % each, and a content of unavoidable impurities less than or equal to 0.05 wt. % each and 0.15 wt. % total, and the alloy being substantially zirconium free.

11 Claims, 3 Drawing Sheets

HIGH FRACTURE TOUGHNESS ALUMINUM-COPPER-LITHIUM SHEET OR LIGHT-GAUGE PLATES SUITABLE FOR FUSELAGE PANELS

CROSS REFERENCE TO RELATED APPLICATIONS

This application claims priority to French Application No. 0512931 filed Dec. 20, 2005, U.S. Provisional Application No. 60/762,864 filed Jan. 30, 2006, and PCT/FR2006/002733 filed Dec. 14, 2006, the contents of which are incorporated herein by reference in their entireties.

BACKGROUND OF THE INVENTION

1. Field of the Invention

The present invention relates generally to aluminum alloys and more particularly, to such alloys, their methods of manufacture and use, particularly in the aerospace industry.

2. Description of Related Art

Continuous efforts are being directed towards the development of materials that could simultaneously reduce weight and increase structural efficiency of high-performance aircraft structures. Aluminum-lithium (AlLi) alloys are very appealing regarding this target because lithium can reduce the density of aluminum by 3 percent and increase the elastic modulus by 6 percent for every weight percent of lithium added. However, AlLi alloys have yet to be extensively used in the aircraft industry due to several drawbacks of early generation alloys such as, for example, inadequate thermal stability, anisotropy and inadequate fracture toughness.

The history of AlLi alloys development is discussed, for example, in a chapter "Aluminum-Lithium Alloys": of the book Aluminum and Aluminum Alloys, (ASM Specialty Handbook, 1994). The first aluminum-lithium alloys (Al—Zn—Cu—Li) were introduced German inventors in the 1920s, followed by the introduction of alloy AA2020 (Al—Cu—Li—Mn—Cd) in the late 1950s and the introduction of alloy 1420 (Al—Mg—Li) in the Soviet Union in the mid-1960s. The only industrial applications of alloy AA2020 were the wings and horizontal stabilizers for RA5C Vigilante aircraft. A typical composition for alloy AA2020 was (in weight percent) Cu: 4.5, Li: 1.2, Mn: 0.5, Cd: 0.2. There were various reasons for the limited applications of the AA2020 alloy, for example, the fact AA2020 exhibited shortcomings in fracture toughness. In addition to the specific effect of Cd, the use of Mn in this alloy was assessed to be one of the reasons of its limited properties. In 1982, E. A. Starke stated (in Metallurgical Transactions A, Vol 13A, p 2267) "The larger Mn-rich dispersoids may also be detrimental to ductility by initiating voids". This idea of a detrimental effect of Mn was broadly recognized by those skilled in the art. For example, in 1991, Blackenship stated (in Proceedings of the Sixth International Aluminum-Lithium Conference, Garmisch-Partenkirchen, p 190), "Manganese-rich dispersoids nucleate voids and thus encourage the fracture process". It was suggested that zirconium should be used instead of manganese for grain structure control. In the same document, Blackenship stated, "zirconium is the alloying element of choice for grain structure control in Al—Li—X".

The development of AlLi alloys continued in the 1980s and led to the introduction of commercial alloys AA8090, AA2090 and AA2091. All these alloys contained zirconium instead of manganese.

In the early 1990s, a new family of AlLi alloys containing silver known under the trademark "Weldalite"® was introduced. These alloys typically contained lower Li and exhibited better thermal stability. U.S. Pat. No. 5,032,359 (Pickens, Martin Marietta) describes alloys containing from 2.0 to 9.8 weight percent of an alloying element consisting of Cu, Mg and mixtures thereof, from 0.01 to 2.0 weight percent of Ag, from 0.2 to 4.1 weight percent of Li and from 0.05 to 1.0 weight percent of a grain refiner additive selected from Zr, Cr, Mn, Ti, B, Hf, V, $TiB_2$ and mixtures thereof. It should be noted that the list of grain refiners proposed by Pickens actually mixes elements used for foundry grain refining (such as $TiB_2$) and elements used for grain structure control during the transformation operations such as zirconium. Even though Pickens stated that, "although emphasis herein shall be placed upon use of zirconium for grain refinement, conventional grain refiners such as Cr, Mn, Ti, B, Hf, V, $TiB_2$ and mixtures thereof may be used", it clearly appears from the history of AlLi alloy development that a prejudice against the use of any element other than Zr for grain structure control existed to the one skilled in the art. Indeed, in all of the examples described by Pickens, Zr was used.

Use of zirconium for grain refining can also be found in an alloy developed more recently (AA2050, see also WO2004/106570), manganese addition being used to improve toughness. In AA2297, which contains lithium, copper, manganese and optionally magnesium but no silver, zirconium is also used for grain refining. U.S. Pat. No. 5,234,662 discloses a preferred composition of 1.6 wt. % Li, 3 wt. % Cu, 0.3 wt. % Mn and 0.12 wt. % Zr. AA2050 and AA2297 alloys have been mainly proposed for thick plates, with a gauge higher than 0.5 inch.

Another family of AlLi alloys, which contained Zn, was described for example in U.S. Pat. No. 4,961,792 and U.S. Pat. No. 5,066,342 and developed in the early 1990s. The metallurgy of these alloys cannot be compared to the metallurgy of "Weldalite"® alloys because the incorporation of a significant amount of zinc, and in particular the combination of zinc with magnesium, significantly modifies the properties of the alloy, for example in terms of strength and corrosion resistance.

In order to use AlLi alloys for fuselage skin applications, the alloys should reach the same or even better performances in strength, damage tolerance and corrosion resistance than currently used Li-free alloys. In particular, resistance to fatigue crack growth is a major concern for those applications and that explains why alloys recognized for their high damage tolerance, such as AA2524 and AA2056 alloys, are traditionally used. Weldability and corrosion resistance are also among other desirable properties. With the increasing trend to reduce costly mechanical fastening operations in the aircraft industry, weldable alloys such as AA6013, AA6056 or AA6156 are introduced for fuselage skin panels. High corrosion resistance is also desirable in order to substitute clad products with less expensive bare products.

It was known that Al—Li alloys often have problems in terms of anisotropy in tensile properties, which in turn, governs the extent of anisotropy in the other mechanical properties. Low yield strength at intermediate test directions, for example 45° to the rolling direction, is a prominent manifestation of the anisotropy.

As far as damage tolerance properties are concerned, the development of an R-Curve is a widely recognized method to characterize fracture toughness properties. The R-curve represents the evolution of the effective stress intensity factor for crack growth as a function of effective crack extension, under increasing monotonic loading. The R-curve enables one to determine the critical load for unstable fracture for any configuration relevant to cracked aircraft structures. The values of stress intensity factor and crack extension are effective values as defined in the ASTM E561 standard. The generally employed analysis of conventional tests on center cracked panels gives an apparent stress intensity factor at fracture [$K_{app}$]. This value does not necessarily vary significantly as a function of R-curve length. However the length of the R-curve—i.e. maximum crack extension of the curve—is an important parameter in itself for fuselage design, in particular for panels with attached stiffeners.

There is a need for a high strength without anisotropy, high fracture toughness, and especially high crack extension before unstable fracture, high corrosion resistance, low density (i.e. not more than about 2.70 g/cm$^3$) Al—Cu—Li alloy for aircraft applications, and in particular for fuselage sheet applications.

SUMMARY OF THE INVENTION

For these and other reasons, the present inventors arrived at the present invention directed to an aluminum copper lithium magnesium silver alloy, that is capable of exhibiting high strength without anisotropy, and high toughness. The present invention is also capable of specifically exhibiting high crack extension before unstable fracture of wide pre-cracked panels, as well as high corrosion resistance.

By employing alloys with a low zirconium content (i.e. preferably less than or equal to about 0.04 wt %) it is possible to achieve high toughness for Al—Cu—Li alloys. It is also possible to achieve an advantageously optimized compromise between static mechanical properties and toughness.

Additional objects, features and advantages of the invention will be set forth in the description which follows, and in part, will be obvious from the description, or may be learned by practice of the invention. Objects, features and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

FIG. 1: R-curve in the T-L direction (CCT760).

FIG. 2: R-curve in the L-T direction (CCT760).

FIG. 3: Evolution of the fatigue crack growth rate in the TL orientation when the amplitude of the stress intensity factor varies.

FIG. 4: Evolution of the fatigue crack growth rate in the LT orientation when the amplitude of the stress intensity factor varies.

FIG. 5: Relative evolution of TYS when the orientation with respect to rolling direction vanes.

DETAILED DESCRIPTION OF A PREFERRED EMBODIMENT

Figure 1:
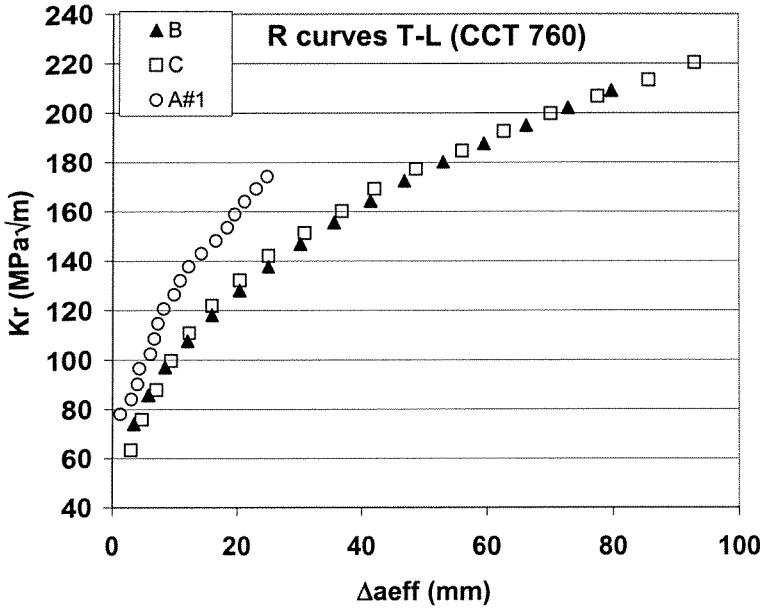
FIGS. 1-5 are directed to certain aspects of the invention as described herein. They are illustrative and not intended as limiting.

Unless otherwise indicated, all the indications relating to the chemical composition of the alloys are expressed as a mass percentage by weight based on the total weight of the alloy. Alloy designation is in accordance with the regulations of The Aluminum Association, known of those skilled in the art. The definitions of tempers are defined by European standard EN 515.

Unless mentioned otherwise, static mechanical characteristics, in other words the ultimate tensile strength UTS, the tensile yield stress TYS and the elongation at fracture A, are determined by a tensile test according to standard EN 10002-1, the location at which the pieces are taken and their direction being defined in standard EN 485-1.

The fatigue crack propagation rate (using the da/dN–ΔK test) is determined according to ASTM E 647. A plot of the effective stress intensity versus effective crack extension, known as the R curve, is determined according to ASTM standard E561. The critical stress intensity factor $K_C$, in other words the intensity factor that makes the crack unstable, is calculated starting from the R curve. The stress intensity factor $K_{CO}$ is also calculated by assigning the initial crack at the beginning of the monotonous load, length to the critical load. These two values are calculated for a test piece of the required shape. $K_{app}$ denotes the $K_{CO}$ factor corresponding to the test piece that was used to make the R curve test. $K_{eff}$ denotes the $K_C$ factor corresponding to the test piece that was used to make the R curve test. $\Delta a_{eff(max)}$ denotes the crack extension of the last point of the R curve, that is valid according to standard ASTM E561. The last point is obtained either when the test sample breaks or possibly when the stress on the uncracked ligament is higher than the yield stress of the material. Unless otherwise mentioned, the crack size at the end of the fatigue precracking stage is W/3 for test pieces of the M(T) type, wherein W is the width of the test piece as defined in standard ASTM E561.

It should be noted that the width of the test panel used in a toughness test could have a substantial influence on the measured R curve. Fuselage sheets being large panels, only toughness results obtained on wide samples, such as samples with a width of at least 400 mm, are deemed significant for a toughness performance evaluation in the present invention. For this reason, only CCT760 test samples, which had a width 760 mm, were used for toughness evaluations. The initial crack length was 2ao=253 mm.

The phrase "sheet or light-gauge plate" as used herein refers to a rolled product not exceeding about 0.5 inch (or 12.7 mm) in thickness.

The term "structural member" as used herein refers to a component used in mechanical construction for which the static and/or dynamic mechanical characteristics are of particular importance with respect to structure performance, and for which a structure calculation is usually prescribed or undertaken. These are typically components the rupture of which may seriously endanger the safety of the mechanical construction, its users or third parties. In the case of an aircraft, structural members include, for example, members of the fuselage (such as fuselage skin), stringers, bulkheads, circumferential frames, wing components (such as wing skin, stringers or stiffeners, ribs, spars), empennage (such as horizontal and vertical stabilisers), floor beams, seat tracks, and doors.

An aluminum-copper-lithium-silver-magnesium-manganese alloy according to one embodiment of the invention advantageously has the following composition:

TABLE 1

| Compositional Ranges of invention Alloys (wt. %, balance Al) | | | | | |
|---|---|---|---|---|---|
| | Cu | Li | Ag | Mg | Mn |
| Broad | 2.1–2.8 | 1.1–1.7 | 0.1–0.8 | 0.2–0.6 | 0.2–0.6 |
| Preferred | 2.2–2.6 | 1.2–1.6 | 0.2–0.6 | 0.3–0.5 | 0.2–0.5 |
| More preferred | 2.3–2.5 | 1.3–1.5 | 0.2–0.4 | 0.3–0.4 | 0.3–0.4 |

Alloys of the present invention are advantageously substantially zirconium free. By "substantially zirconium free", it is meant that the zirconium content shall be less than about 0.04 wt % and preferably less than about 0.03 wt % and still more preferably less than about 0.01 wt %.

Unexpectedly, the present inventors discovered that a low zirconium content enabled an improvement in toughness of Al—Cu—Li—Ag—Mg—Mn alloys; in particular the length of the R-curve in both the T-L and L-T directions was significantly increased. The use of manganese instead of zirconium for grain structure control had several additional advantages such as obtaining a recrystallized structure and beneficial isotropic properties over a wide range of thicknesses from 0.8 to 12 mm or from about 1/32 to about 1/2 inch.

Fe and Si typically affect fracture toughness properties. The amount of Fe should preferably be limited to 0.1 wt. % (preferably not more than 0.05 wt. %) and the amount of Si should preferably be not more than 0.1 wt. % (preferably not more than 0.05 wt. %). All unavoidable impurities should advantageously be limited to 0.05 wt. %. If the alloy does not include any additional alloying elements, the remainder is aluminum.

The present inventors found that if the copper content is higher than about 2.8 wt. %, the fracture toughness properties may in some cases, rapidly drop, whereas if the copper content is lower than about 2.1 wt. %, mechanical strength may be too low.

As far as lithium content is concerned, lithium content higher than 1.7 wt. % leads to problems of thermal stability. A lithium content lower than 1.2 wt. % results in inadequate strength and a lower gain in density.

It was also found by the present inventors that if the silver content is less than about 0.1 wt. %, the mechanical strength obtained may not meet desired properties. The silver content should however advantageously be maintained below 0.8 wt. % and preferably below 0.4 wt. %, to avoid an increase of density and for cost reasons.

Extruded, rolled or forged products can be made with an alloy according to the present invention. Advantageously an alloy according to the present invention can be used to make sheet or light gauge plates.

Products according to the present invention exhibit a very high fracture toughness performance. The inventors suspect that the absence of Zr in products according to the invention may be related to this performance in terms of fracture toughness. Zr and Mn, which can both be used for grain structure control, exhibit very different behaviors. As a peritectic element, Zr is usually enriched in the grain center and depleted at the grain boundaries, whereas Mn, which is a eutectic element with a partition coefficient close to one, is distributed much more homogeneously during solidification. The different behavior of Zr and Mn during solidification might be related to their different effects observed in terms of fracture toughness. A recrystallized structure, which is favored here by the substantially zirconium free composition, may also by itself have a beneficial effect on toughness. Advantageously, the recrystallization rate of products according to the present invention is at least 80%.

The present inventors found that a homogenization temperature should be preferentially be from 480 to 520° C. for 5 to 60 hours and even more preferentially, from 490 to 510° C. for 8 to 20 hours. The present inventors also observed that homogenization temperatures higher than 520° C. may tend to reduce the performance in terms of fracture toughness in some instances. The inventors believe that the technical effect of homogenization conditions is in relation with the described different behavior during solidification.

For sheet and light-gauge plate manufacture, the hot-rolling initial temperature, is preferentially 450-490° C. For sheet and light gauge plates, hot rolling is preferably carried out approximately to from 4 to 12.7 mm gauge slabs. For approximately 4 mm gauge or less, a cold rolling step can optionally be added if desired for any reason. For sheet or light-gauge plate manufacture, the sheet or light-gauge plate obtained preferably ranges from 0.8 to 12.7 mm gauge, and the present invention is more advantageous for 1.6 to 9 mm gauge slabs, and even more advantageous for 2 to 7 mm gauge slabs. A product according to the instant invention is then solution heat treated, preferably, by soaking at 480 to 520° C. for 15 min to 4 h and quenched with room temperature water.

The product is then stretched from 1 to 5%, and preferentially from 2 to 4%. If the stretching is higher than 5%, the mechanical properties may not be as improved and industrial difficulties such as high ratio of defective parts could be encountered, which could increase the cost of the product. Aging is carried out at 140-170° C. for 5 to 80 h, and more preferentially at 140-155° C. for 20-80 h. Lower solution heat-treating temperatures generally favor high fracture toughness. In one embodiment of the present invention comprising a welding step, the aging step can be divided into two steps: a pre-aging step prior to a welding operation, and a final heat treatment to form a welded structural member.

Characteristics of the sheets and light-gauge plates obtained with the present invention include one or more of the following:

The tensile yield strength in the L-direction is preferably at least 390 MPa or even 400 MPa.

The ultimate tensile strength in the L-direction is preferably at least 410 MPa or even 420 MPa.

The tensile yield strength at 45° to the rolling direction is at least equal to the tensile yield strength in the LT direction.

The difference between the tensile yield strength at 45° to the rolling direction and the tensile yield strength in the LT direction as defined by (TYS (TL)−TYS (45°))/TYS (TL) is between +5% and −5% and preferably between +3% and −3%.

The fracture toughness properties using CCT760 (2ao=253 mm) specimens include one or more of the following:

$K_{app}$ in T-L direction is preferably at least 100 MPa$\sqrt{m}$, and preferentially at least 120 MPa$\sqrt{m}$;

$K_{app}$ in L-T direction is at least 150 MPa$\sqrt{m}$, and preferentially at least 160 MPa$\sqrt{m}$;

$K_{eff}$ in T-L direction is at least 120 MPa$\sqrt{m}$, and preferentially at least 150 MPa$\sqrt{m}$;

$K_{eff}$ in L-T direction is at least 160 MPa$\sqrt{m}$, and preferentially at least 220 MPa$\sqrt{m}$;

$\Delta a_{eff\,(max)}$, the crack extension of the last valid point of the R-curve in T-L direction is preferably at least 60 mm, and preferentially at least 80 mm;

$\Delta a_{eff\,(max)}$ from R-curve in L-T direction is preferably at least 60 mm, and preferentially at least 80 mm.

The terms high strength, high fracture toughness, high crack-extension before unstable fracture, low anisotropy as used herein refer to products displaying one or more of the properties mentioned above.

Advantageously, the recrystallization rate of the sheets or light gauge plates according to the invention is at least about 80%.

Forming of products of the present invention may advantageously be made by stretch-forming, deep drawing, pressing, spinning, rollforming and/or bending, these techniques being known to persons skilled in the art. For the assembly of the structural part, all known and possible adhesive bonding, riveting and welding techniques suitable for aluminum alloys can be used if desired. The products may be fixed to stiffeners or frames, for example, by adhesive bonding, riveting or welding. The inventors have found that if welding is chosen, it may be preferable to use low heat welding techniques, which helps ensure that the heat affected zone is as small as possible (is minimizing). In this respect, laser welding and friction stir welding often give particularly satisfactory results.

Products of the present invention, before and/or after forming, may advantageously be subjected to artificial aging to impart improved static mechanical properties. This artificial aging may also be conducted in any advantageous manner on an assembled structural part if desired. Products of the invention can advantageously be used for the manufacture of structural members for aeronautical construction. A structural part can be formed of a sheet or light-gauge plate according to the present invention and of stiffeners and/or frames. Stiffeners or frames are preferably made of extruded profiles. Structural parts may be used for example and in particular for airplane fuselage panels construction as well as for any other use where the instant properties could be advantageous.

The present inventors found that products of the invention have particularly favorable compromise between static mechanical properties, fracture toughness and density. For known low-density products, the high tensile and yield strengths sheet or light-gauge plates generally have a low fracture toughness. For the sheet or light-gauge plate of the invention, the high fracture toughness properties, and in particular the very long R-curve properties favor industrial application for aircraft fuselage skin parts. Some embodiments of the present invention have densities of not more than about 2.70 g/cm$^3$ even not more than 2.69 g/cm$^3$ and even more preferably of not more than about 2.66 g/cm$^3$.

Products of the invention generally do not raise any particular problems during subsequent surface treatment operations conventionally used in aircraft manufacturing, in particular for mechanical or chemical polishing, or treatments intended to improve the adhesion of polymer coatings.

Resistance to intergranular corrosion of products of the present invention is generally high; for example, typically only pitting is detected when the metal is submitted to corrosion testing. In a preferred embodiment of the invention, the sheet or light-gauge plate of the invention can be used without cladding on either surface with a low composition aluminum alloy.

These as well as other aspects of the present invention are explained in more detail with regard to the following illustrative and non-limiting example:

EXAMPLE

The inventive example is labeled C. Examples B and D do not include Ag are presented for comparison purposes. Sample D has a Cu content outside the invention as well. Example A is a reference AA2098 silver containing alloy and employs Zr as opposed to Mn for grain structure control and employs high Cu. The chemical compositions of the various alloys tested are provided in Table 2.

TABLE 2

| Chemical composition (weight %) | | | | | | | | | | | |
|---|---|---|---|---|---|---|---|---|---|---|---|
| Cast reference | Si | Fe | Cu | Mn | Mg | Cr | Zn | Zr | Li | Ag | Ti |
| A (2098) | 0.03 | 0.04 | 3.6 | 0.01 | 0.32 | 0.01 | 0.01 | 0.14 | 1.0 | 0.33 | 0.02 |
| B | 0.03 | 0.04 | 2.2 | 0.29 | 0.3 | — | — | <0.01 | 1.4 | — | 0.02 |
| C | 0.03 | 0.03 | 2.4 | 0.29 | 0.3 | — | — | <0.01 | 1.4 | 0.34 | 0.02 |
| D | 0.28 | 0.03 | 1.5 | 0.28 | 0.3 | — | — | <0.01 | 1.4 | — | 0.03 |

The density of the different alloys tested is presented in Table 3. Samples B to D exhibit the lowest density of the different materials tested.

TABLE 3

| Density of the alloys tested | |
|---|---|
| Reference | Density (g/cm$^3$) |
| A (2098) | 2.70 |
| B | 2.64 |
| C | 2.64 |
| D | 2.62 |

The methods used to manufacture the different samples are presented in Table 4.

TABLE 4

| Conditions of the consecutive steps of transformation | | |
|---|---|---|
| | Reference A | References B, C and D |
| Temper | T8 | T8 |
| Stress relieving by heating | Yes | Yes |

TABLE 4-continued

| Conditions of the consecutive steps of transformation | | |
|---|---|---|
| | Reference A | References B, C and D |
| Homogenizing | 8 h at 500° C. + 36 h at 526° C. | 12 h at 500° C. |
| Hot-rolling initial temperature | 485° C. | 450 to 490° C. |
| Hot rolling | Thickness >4 mm | Thickness >4 mm. Hot rolling exit temperature <280° C. |
| Cold rolling | Thickness <4 mm | Thickness <4 mm, optional intermediate annealing |
| Solution heat treating | 2 h at 521° C. | 1 h at 500° C. |
| Quenching | Water at room temperature | Water at room temperature |
| Stretching | 1–5% permanent set | 1–5% permanent set |
| Aging | 14 h at 155° C. (4.5 mm) 18 h at 160° C. (6.7 mm) | 48 h at 152° C. |

The grain structure of the samples was characterized by microscopic observation of cross sections after anodic oxidation, under polarized light or after chromic etching. A recrystallization rate was determined. The recrystallization rate is defined as the surface fraction of recrystallized grains. The recrystallization rate was 100% for samples B, C and D. For samples A#1 and A#2, the recrystallization rate was less than 20%.

The samples were mechanically tested to determine their static mechanical properties as well as their resistance to crack propagation. Tensile yield strength, ultimate strength and elongation at fracture are provided in Table 5.

TABLE 5

| Mechanical properties of the samples | | | | | | | | | | |
|---|---|---|---|---|---|---|---|---|---|---|
| | | L direction | | | LT direction | | | 45° direction | | |
| Sample | Thickness | UTS (MPa) | TYS (MPa) | E (%) | UTS (MPa) | TYS (MPa) | E (%) | UTS (MPa) | TYS (MPa) | E (%) |
| A#1 | 4.5 | 573 | 549 | 11.0 | 559 | 528 | 12.0 | | | |
| A#2 | 6.7 | 559 | 537 | 11.3 | 553 | 529 | 10.9 | 494 | 459 | 15.3 |
| B | 5 | 409 | 373 | 14.2 | 396 | 344 | 13.2 | 398 | 348 | 14.0 |
| C | 5 | 439 | 414 | 14.0 | 434 | 386 | 11.9 | 433 | 387 | 13.1 |
| D | 5 | | | | 295 | 228 | 15.8 | | | |

Figure 5:
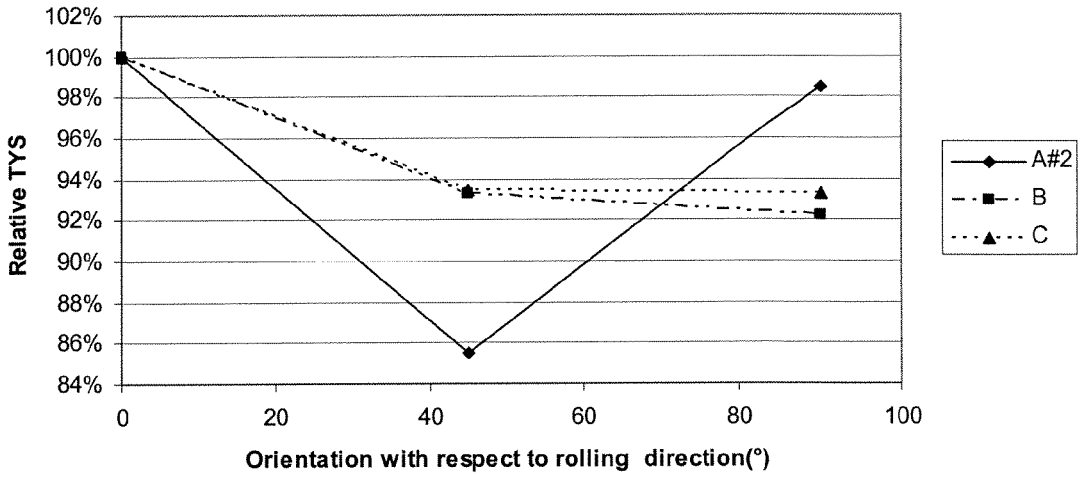

The static mechanical properties of the samples according to the invention are comparable to conventional damage tolerant 2XXX series alloy, lower than high strength alloys such as 7475 or 2098 (as tested in Sample A). The strength of the comparison alloy B was lower than that of the alloy according to the invention (C), which might be related to the absence of silver in the comparison alloy B. The inventors believe that the lower copper content and the lower zirconium content of the sample according to the invention explains the lower strength compared to 2098 alloy (sample A). Anisotropy was very low for sample C according to the invention as shown in FIG. 5, which shows the relative evolution of TYS when the orientation with respect to rolling direction varies. Thus, the difference between the tensile yield strength at 45° to the rolling direction and the tensile yield strength in the LT direction as defined by (TYS (TL)−TYS (45°))/TYS (TL) was −0.3% for sample C whereas it was 13.2% for the reference sample A (AA2098).

Figure 2:
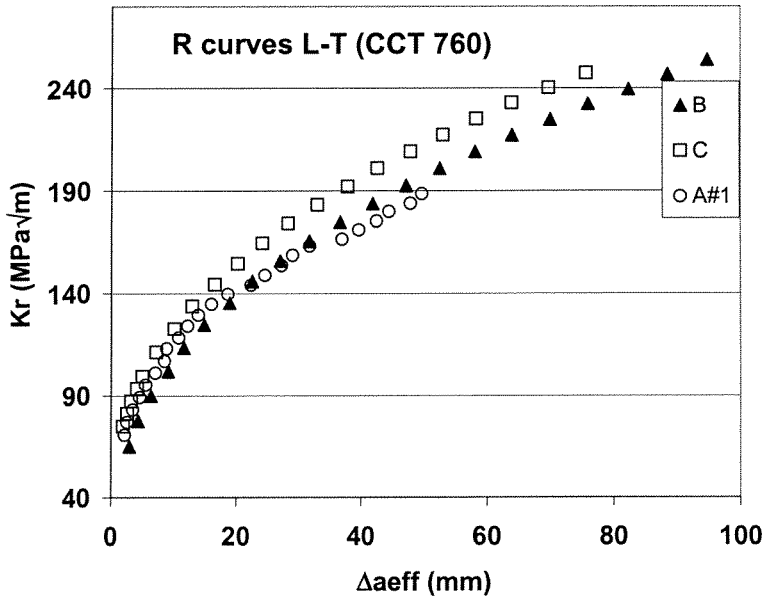

Moreover, sample C according to the invention exhibits high fracture toughness properties. R-curves of samples A#1, B and C are provided in FIGS. 1 and 2, for T-L and L-T directions, respectively. FIG. 1 clearly shows that the crack extension of the last valid point of the R-curve ($\Delta_{aeff(max)}$) is much larger for samples from the invention than from sample A#1 and B. This parameter is at least as critical as the $K_{app}$ values because, as explained in the description of related art, the length of the R-curve is an important parameter for fuselage design. FIG. 2 shows the same trend, but the difference is smaller because the L-T direction intrinsically gives better results. Table 6 summarizes the results of toughness tests.

TABLE 6

| Results of toughness tests | | | | | |
|---|---|---|---|---|---|
| | | T-L (760 mm wide specimen) | | L-T (760 mm wide specimen) | |
| Sample | Thickness [mm] | $K_{app}$ (MPa√m) | $K_{eff}$ (MPa√m) | $K_{app}$ (MPa√m) | $K_{eff}$ (MPa√m) |
| A#1 | 4.5 | 154 | 174 | 148 | 188 |
| A#2 | 6.7 | 103 | 112 | 123 | 143 |

TABLE 6-continued

| Results of toughness tests | | | | | |
|---|---|---|---|---|---|
| | | T-L (760 mm wide specimen) | | L-T (760 mm wide specimen) | |
| Sample | Thickness [mm] | $K_{app}$ (MPa√m) | $K_{eff}$ (MPa√m) | $K_{app}$ (MPa√m) | $K_{eff}$ (MPa√m) |
| B | 5.0 | 143 | 209 | 161 | 232 |
| C | 5.0 | 143 | 200 | 172 | 247 |

The results originating from the R-curve are grouped together in Table 7. Crack extension of the last valid point of the R-curve is higher for invention sample C than for reference sample A#1. The inventors believe that several reasons can be proposed to explain this performance, unexpectedly the absence of Zr could be a major contributor, directly or indirectly, to the performance in fracture toughness.

TABLE 7

R-curve summary data

| Δa [mm] | | 10 | 20 | 30 | 40 | 50 | 60 | 70 | 80 |
|---|---|---|---|---|---|---|---|---|---|
| $K_r$ | A#1 | 125 | 161 | — | — | | | | — |
| (T-L direction) | B | 102 | 128 | 147 | 162 | 176 | 188 | 199 | 210 |
| [MPa√m] | C | 101 | 130 | 150 | 166 | 179 | 190 | 200 | 209 |
| $K_r$ | A#1 | 115 | 141 | 159 | 174 | 185 | | | |
| (L-T direction) | B | 106 | 139 | 162 | 181 | 197 | 211 | 224 | 236 |
| [MPa√m] | C | 123 | 154 | 177 | 196 | 212 | 227 | 241 | 254 |

Figure 3:
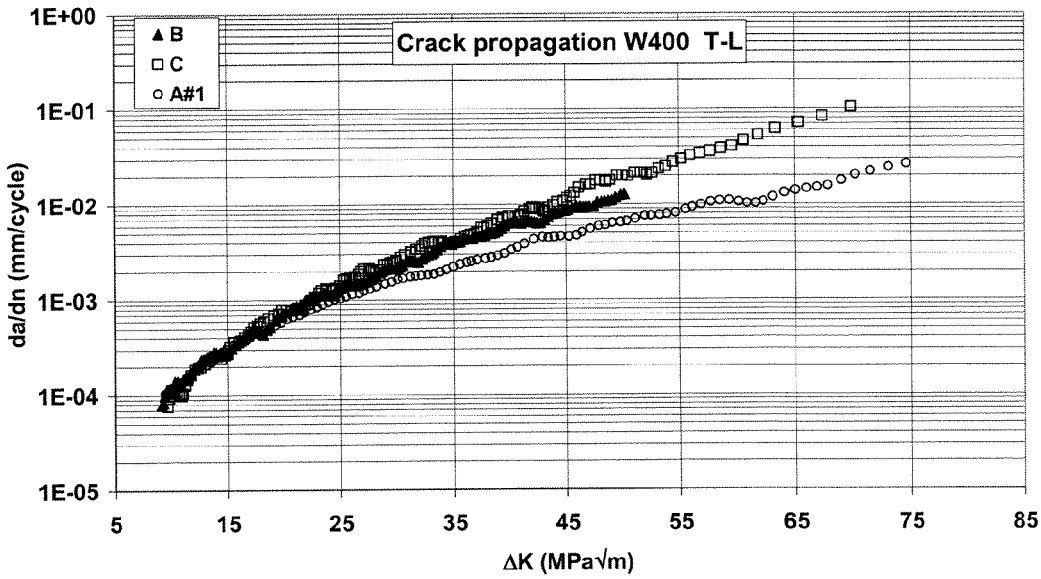
Figure 4:
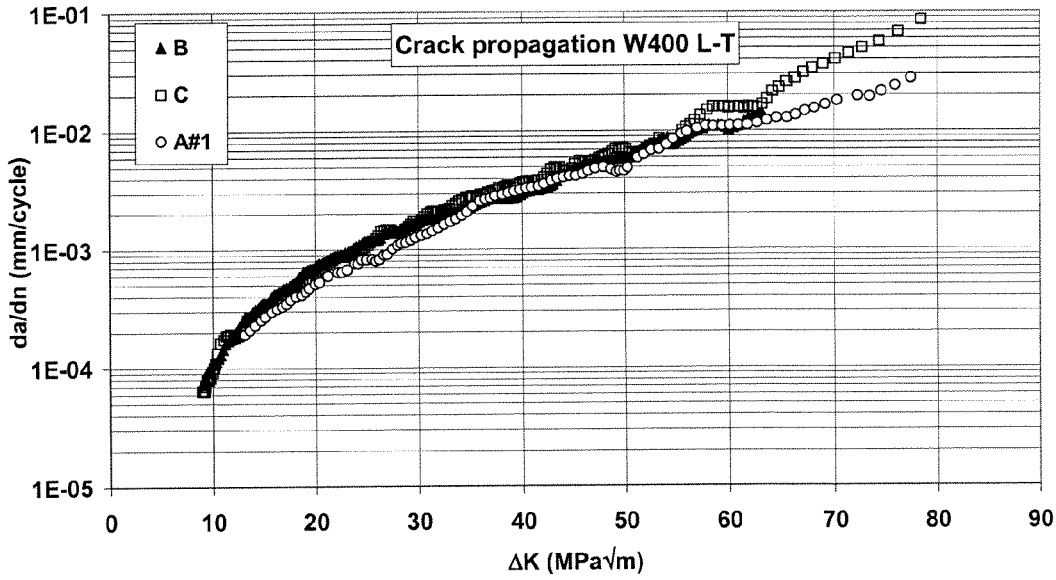

FIGS. 3 and 4 show the evolution of the fatigue crack growth rate in the T-L and L-T orientation, respectively, when the amplitude of the stress intensity factor varies. The width of sample was 400 mm (CCT 400 specimen) and R=0.1. No major difference was observed between samples A, B and C. Sample C fatigue crack propagation rate is on the same range as typical values obtained for AA6156 and AA2056 alloys.

Resistance to intergranular corrosion of the samples A#1, B and C was tested according to ASTM G110. For each sample, no intergranular corrosion was detected. Therefore, resistance to intergranular corrosion was, high for the samples according to the present invention.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

In the present description and in the following claims, to the extent a numerical value is enumerated, such value is intended to refer to the exact value and values close to that value that would amount to an insubstantial change from the listed value.

The invention claimed is:

1. An aluminum alloy rolled product not exceeding 0.5 inch in thickness comprising 2.3 to 2.5 wt. % Cu, 0.2 to 0.6 wt. % Li, 0.1 to 0.4 wt. % Ag, 0.2 to 0.4 wt. % Mg, 0.2 to 0.4 wt. % Mn, a content of Fe and Si less or equal to 0.05 wt. % each, and a content of unavoidable impurities less than or equal to 0.05 wt. % each and 0.15 wt. % total, and the alloy being substantially zirconium free, wherein said zirconium is present an amount of not more than about 0.04 wt. %, wherein said product comprises a difference between the tensile yield strength at 45° to the rolling direction and the tensile yield strength in the LT direction as defined by (TYS (TL)−TYS))(45° /TYS (TL) from +5% to -5%, an ultimate tensile strength in the L-direction of at least 420 MPa, and the fracture toughness using CCT760 (2a0=253 mm), including a crack extension of the last valid point of the R-curve Δaeff(max), in the T-L direction, of at least 60 mm and $K_{app}$ in T-L direction of at least 100 MPa√m, and wherein the product has a recrystallization rate of at least 80%.

2. An aluminum alloy product according to claim 1 comprising 2.3 to 2.5 wt. % Cu, 1.3 to 1.5 wt. % Li, 0.2 to 0.4 wt. % Ag, 0.3 to 0.4 wt. % Mg, and 0.3 to 0.4 wt. % Mn.

3. A method for producing an aluminum alloy sheet or light gauge plate comprising a product of claim 1 having high fracture toughness and strength, said method comprising:

(a) casting an ingot consisting essentially of 2.3 to 2.5 wt. % Cu, 1.2 to 1.6 wt. % Li, 0.1 to 0.4 wt. % Ag, 0.2 to 0.4 wt. % Mg, and 0.2 to 0.4 wt. % Mn, a content of Fe and Si less than or equal to 0.1 wt. % each, and a content of unavoidable impurities less than or equal to 0.05 wt. % each and 0.15 wt. % total, and wherein said alloy is substantially zirconium free, wherein said zirconium is present an amount of not more than about 0.04 wt %, (b) homogenizing said ingot at 480-520° C. for about 5 to about 60 hours, (c) hot rolling said ingot to a slab, with an hot rolling initial temperature of about 450° C. to about 490° C. and optionally cold rolling said slabs, (d) solution heat treating said slabs at about 480° C. to about 520° C. for about 15 min. to about 4 hours, (e) quenching said slabs, (f) stretching said slabs with a permanent set from about 1 to about 5%, (g) aging said slab by heating at about 140° C. to about 170° C. for about 5 to about 80 hours (h) resulting in a sheet or light gauge plate comprising a product of claim 1.

4. A method according to claim 3, wherein the thickness of said sheet or light gauge plate is from 0.8 mm to 12.7 mm.

5. A rolled product produced by a method of claim 3, wherein said rolled product comprises (a) a tensile yield strength in the L-direction of at least 390 MPa, a difference between the tensile yield strength at 45° to the rolling direction and the tensile yield strength in the LT direction as defined by (TYS (TL)−TYS(45°))/TYS (TL) from +5% to −5%, (b) a plane stress fracture toughness $K_{app}$, measured on CCT760 (2ao=253 mm) specimens, of at least 100 MPa√m, (c) and/or a crack extension of the last valid point of the R-curve $\Delta a_{eff(max)}$ in the T-L direction of at least 60 mm, (d) an ultimate tensile strength in the L-direction of at least 420 MPa.

6. An aircraft fuselage panel comprising at least one rolled product according to claim 5.

7. A structural member for aeronautical construction comprising at least one product according to claim 1.

8. An aluminum alloy product according to claim 1 wherein zirconium is less than or equal to 0.01 wt. %.

9. A method according to claim 4, wherein said thickness is from 1.6 mm to 9 mm.

10. A rolled product of claim 5, wherein said difference is from +3% to −3%, said plane stress fracture toughness is at least 120 MPa√m in the T-L direction and said crack extension is at least 80 mm.

11. A product of claim 1, wherein said crack extension of the last valid point of the R-curve Δaeff(max), in the T-L direction is at least 80 mm.

* * * * *

UNITED STATES PATENT AND TRADEMARK OFFICE

CERTIFICATE OF CORRECTION

PATENT NO. : 8,771,441 B2
APPLICATION NO. : 11/612131
DATED : July 8, 2014
INVENTOR(S) : Bernard Bes et al.

It is certified that error appears in the above-identified patent and that said Letters Patent is hereby corrected as shown below:

IN THE CLAIMS:

In Column 11, Lines 53-54, in Claim 1, delete "0.2 to 0.6 wt. % Li," and insert --1.2 to 1.6 wt. % Li,--, therefor.

In Column 11, Lines 63-64, in Claim 1, delete "(TYS (TL)-TYS))(45° /TYS (TL)" and insert --(TYS (TL)-TYS (45°))/TYS (TL)--, therefor.

Signed and Sealed this
Third Day of May, 2016

Michelle K. Lee

Michelle K. Lee
*Director of the United States Patent and Trademark Office*